United States Patent [19]

Hall

[11] 4,357,994

[45] Nov. 9, 1982

[54] HYDRAULIC WELL EQUIPMENT HOIST

[76] Inventor: Ellis C. Hall, Rte. 5, Box 963, Jackson, Miss. 39212

[21] Appl. No.: 147,378

[22] Filed: May 7, 1980

[51] Int. Cl.[3] ..... B66B 11/04

[52] U.S. Cl. ..... 187/17; 182/63; 52/115

[58] Field of Search ..... 187/17, 8.59, 9 R, 9 E; 254/93 R; 173/150; 92/146; 182/63, 141; 52/115

[56] References Cited

U.S. PATENT DOCUMENTS

| | | | |
|---|---|---|---|
| 815,594 | 3/1906 | Kovacevic | 187/17 |
| 3,338,334 | 8/1967 | Matthews | 187/8.59 |
| 3,360,078 | 12/1967 | Hopsold | 187/9 E |
| 3,534,664 | 10/1970 | Ulinski | 187/17 |
| 3,970,171 | 7/1976 | Honecker et al. | 187/9 E |

*Primary Examiner*—Robert J. Spar
*Assistant Examiner*—Kenneth Noland
*Attorney, Agent, or Firm*—Harvey B. Jacobson

[57] ABSTRACT

A vertically elongated frame is provided including pairs of opposite sides and each opposite side includes a pair of upstanding opposite side guides. First, second and third pairs of upper, intermediate and lower hydraulic cylinders are provided on each frame side and the lower portion of each upper cylinder lower portion is communicated with the upper portion of the next lower cylinder upper portion whereby fluid pressure in all of the cylinders is maintained equal and the cylinders may extend in sequence with the upper cylinders extending first, the intermediate cylinders extending second and the lower cylinders extending last. Further, the equalization of the fluid pressures within the cylinders also enables the cylinders to retract in sequence with the lower cylinders retracting first, the intermediate cylinders retracting second and the upper cylinders retracting third. With all of the interiors of the hydraulic cylinders communicated a single supply line may be provided to supply hydraulic fluid under pressure thereto and safety valves may be operatively associated with the various upper, intermediate and lower cylinders of automatically preventing the venting of hydraulic fluid therefrom in the event a hydraulic leak occurs in the main supply system to the cylinders.

7 Claims, 9 Drawing Figures

FIG. 5
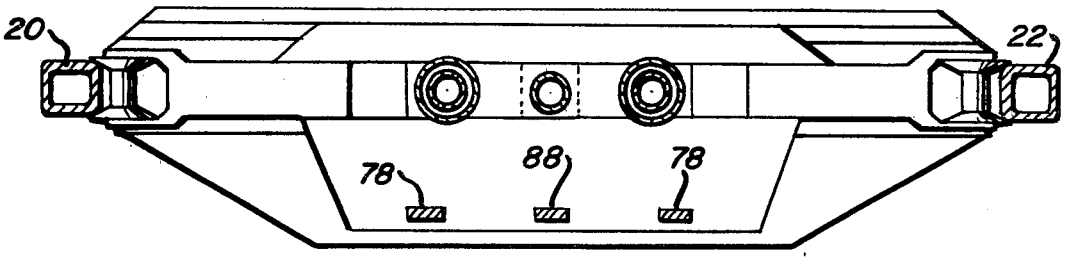
FIG. 6
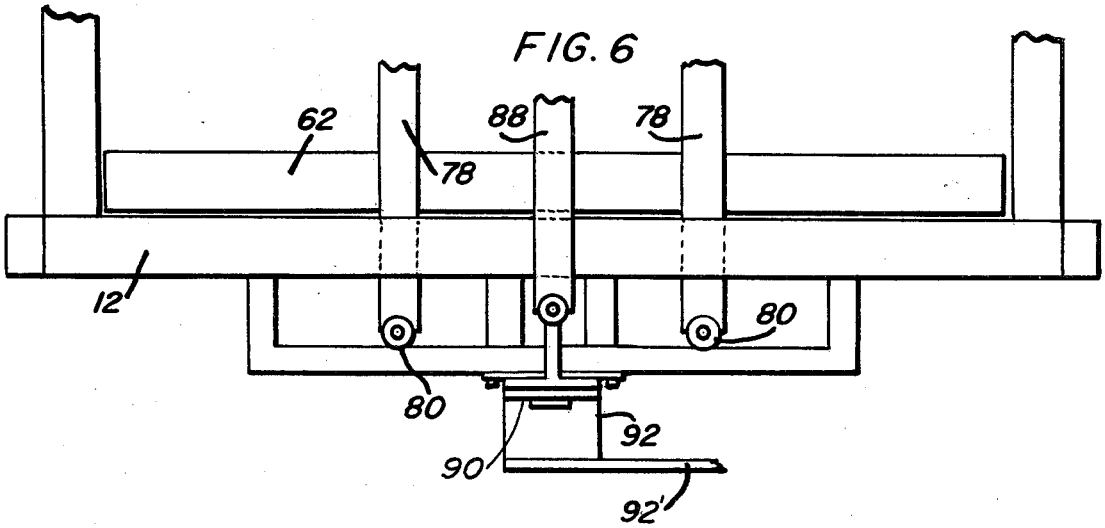
FIG. 7
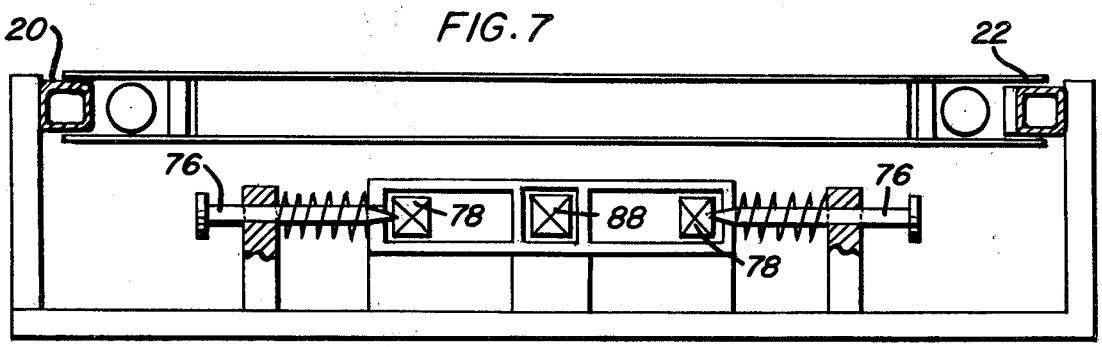
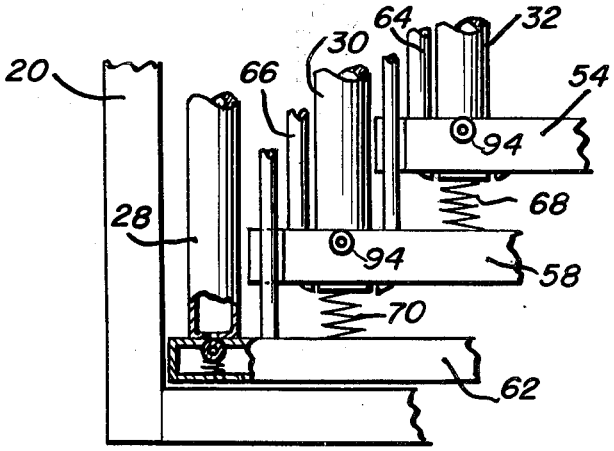
FIG. 8

28
28
28
28
94
94
106
TO HIGH PRESS. PUMP
104
100
102
RAISE
STOP
EMERGENCY STOP
TO SAFETY PUMP
TO SAFETY VALVES
92'
TO TANK
108

HYDRAULIC WELL EQUIPMENT HOIST

BACKGROUND OF THE INVENTION

Various forms of hoists heretofore have been provided for hoisting casing sections and the like into position relative to an oil well. However, most of these previously known forms of hoists have utilized lifting cables under the control of winches and are subject to malfunction and thus accidents sometimes occur adjacent an oil well when an hoist cable breaks.

Accordingly, a need exists for an improved form of hoist for operation immediately adjacent an oil well.

Examples of previously known forms of hydraulic lifting devices including some of the general structural and operational features of the instant invention are disclosed in U.S. Pat. Nos. 3,768,578, 3,957,125, 3,958,376, 3,970,171.

BRIEF DESCRIPTION OF THE INVENTION

The hoist of the instant invention utilizes three sets of serially connected hydraulic cylinders on opposite sides of a vertically elongated frame with the three sets of cylinders arranged in uppermost, intermediate and lowermost cylinders and communicated with each other for equal hydraulic pressure throughout in a manner such that the uppermost cylinders are first extended and the last retracted, the intermediate cylinders are second extended and second retracted and the lowermost cylinders are last extended and first retracted.

The main object of this invention is to provide an improved hydraulic hoist structure for use in conjunction with oil wells and constructed in a manner whereby malfunction of the hoist will be reduced to a minimum and substantially all malfunctions of the hoist may be readily controlled to prevent uncontrolled dropping of the lifting head thereof.

Another object of this invention is to provide an improved hoist construction in accordance with the preceding objects and wherein a single supply of hydraulic fluid under pressure may be utilized to successively extend and retract the uppermost, intermediate and lowermost cylinders of the hoist.

Still another important object of this invention is to provide a hydraulic hoist including safety valves wherein a rupture of a hydraulic line or other part of the hydraulic supply system supplying hydraulic fluid under pressure to the cylinders will not result in uncontrolled lowering of the lifting head of the hoist.

A final object of this invention to be specifically enumerated herein is to provide an improved hydraulic hoist in accordance with the preceding objects and which will conform to conventional forms of manufacture, be of simple construction and easy to use so as to provide a device that will be economically feasible, long lasting and relatively trouble free in operation.

These together with other objects and advantages which will become subsequently apparent reside in the details of construction and operation as more fully hereinafter described and claimed, reference being had to the accompanying drawings forming a part hereof, wherein like numerals refer to like parts throughout.

BRIEF DESCRIPTION OF THE FIGURES

FIG. 5 is a fragmentary enlarged horizontal sectional view taken substantially upon the plane indicated by the section line 5—5 of FIG. 1;

FIG. 6 is a schematic view illustrating the manner in which the safety valve lockout member is held in an upwardly displaced active position by hydraulic pressure;

FIG. 7 is a fragmentary enlarged horizontal sectional view taken substantially upon the plane indicated by the section line 7—7 of FIG. 1;

FIG. 8 is a fragmentary elevational view of the lower portion of one side of the hoist with all of the hydraulic cylinders fully collapsed.

DETAILED DESCRIPTION OF THE INVENTION

Figure 1:
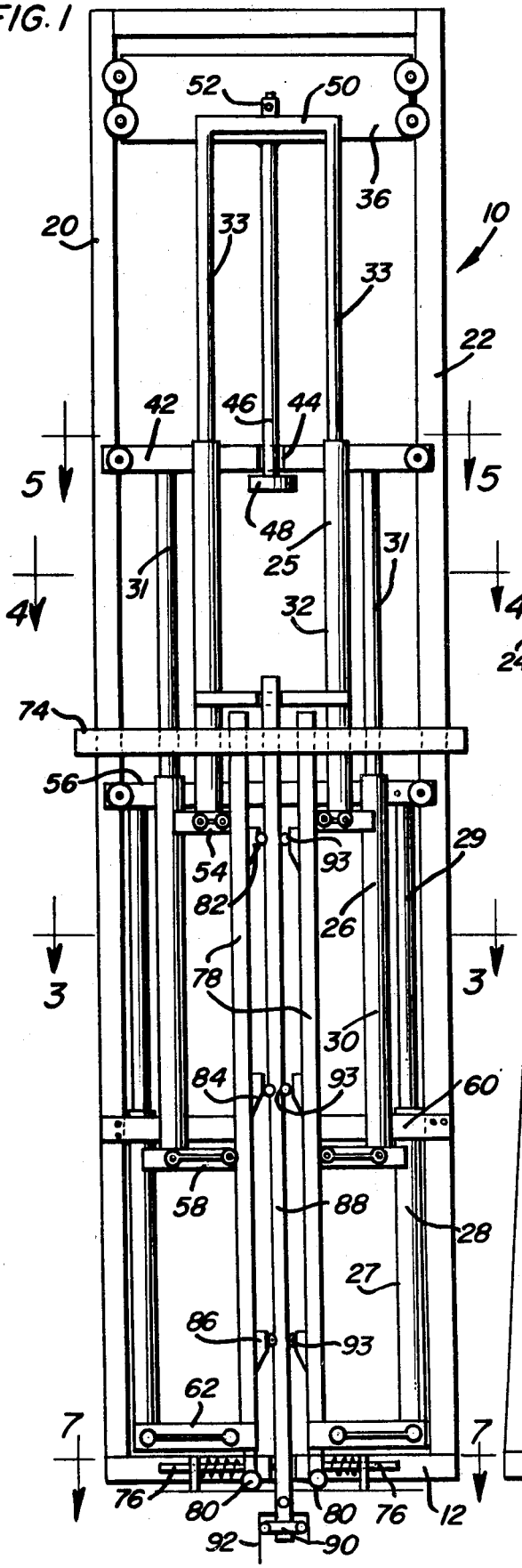
FIG. 1 is a side elevational view of the hydraulic hoist of the instant invention with the three hydraulic cylinder sections thereof fully extended.
Figure 2:
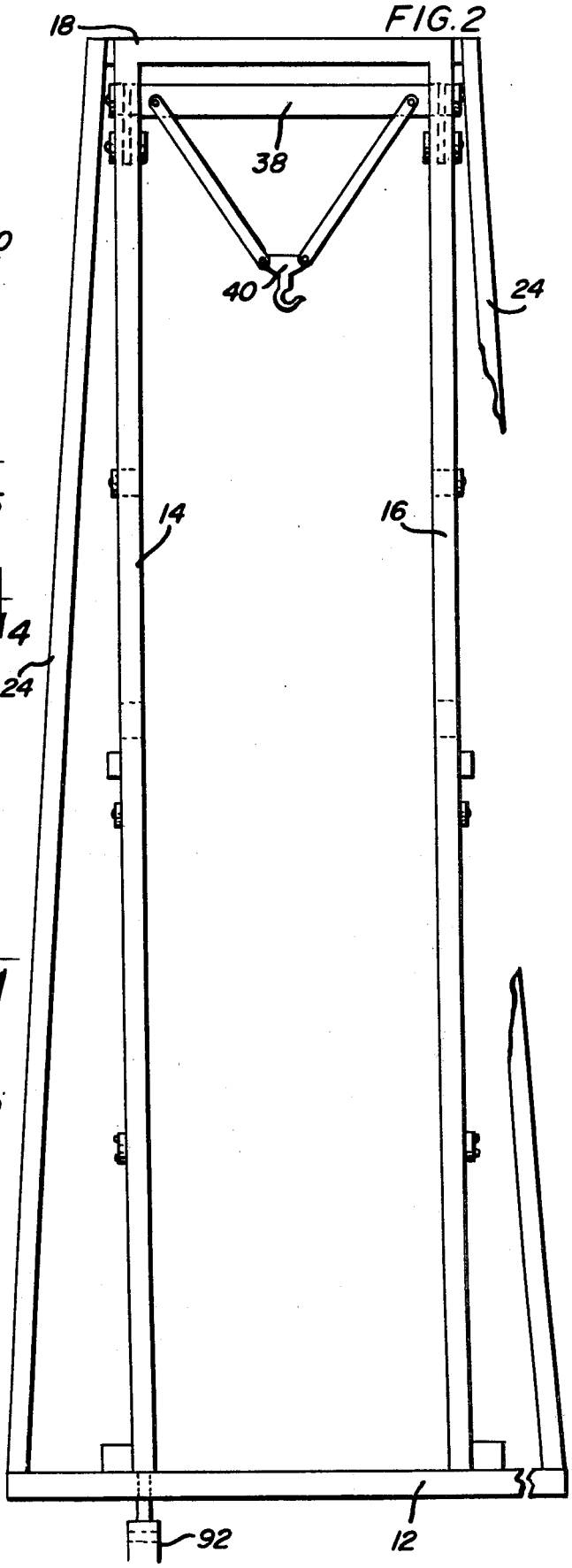
FIG. 2 is a side elevational view of the hoist as seen from the right side of FIG. 1.

Referring now more specifically to the drawings the numeral 10 generally designates the hoist of the instant invention. The hoist 10 includes a base 12 from which a pair of opposite side frames 14 and 16 project upwardly. The upper ends of the side frames 14 and 16 are interconnected by an upper horizontal frame 18 and the side frames 14 and 16 each include opposite side upright guides 20 and 22 and are braced by inclined bracing members 24.

Each side frame 14 and 16 includes three pairs of upper, intermediate and lower hydraulic cylinders 25, 26 and 27 supported therefrom. The lowermost cylinders 27 include lower cylinder portions 28 and upper extendible and tubular piston rod portions 29. The intermediate cylinders 26 include lower cylinder portions 30 and upper extendible tubular piston rod portions 31. Finally, the upper cylinders 25 include lower cylinder portions 32 and extendible tubular piston rod portion 33. The upper ends of each corresponding pair of piston rod portions are interconnected by a lifting head 36 and the lifting heads 36 are interconnected by a brace 38 extending therebetween. Actually, the lifting heads 36 comprise braces rigidly interconnecting the upper ends of the piston rod portions 33 and extending between and guidingly engaged with the guides 20 and 22.

A further or second brace 42 extends between the upper ends of the cylinder portions 31 of the cylinders 26 and is also guidingly engaged with the guides 22 and 24. The brace 42 defines a passage 44 extending vertically therethrough and through which the lower end of a stop bar 46 is slidingly received. The upper end of the stop bar 46 is supported from the lifting head 36 and the lower end thereof includes a diametrically enlarged head 48 below the brace 42 and upwardly abuttingly engageable thereagainst to limit upward extension of the piston rod portions 33 of the cylinders 25. As hereinbefore set forth, the piston rod portions 33 are tubular and their upper ends are communicated by a connecting conduit 50 equipped with an air vent valve 52. The brace 42 rigidly interconnects the upper ends of the piston rod portions 31 of the cylinders 26 and also the upper ends of the cylinder portions 32 of the cylinders 25. A third brace 54 rigidly interconnects the lower ends of the cylinder portions 32 of the cylinders 25 and a fourth brace 56 rigidly interconnects the upper ends of the cylinder portions 30 of the cylinders 26 and the upper ends of the piston rod portions 29 of the cylinders 27. Further, the opposite ends of the brace 56 guidingly engage the guides 20 and 22, as do the opposite ends of the guide 42.

Still further, a fifth brace 58 extends between the lower ends of the cylinder portions 30 of the cylinders 26. The upper ends of the cylinder portions 28 of the cylinders 27 are braced by a transverse brace 60 extending between the guides 20 and 22 and yet another brace 62 extends between the lower ends of the cylinder portions 28 of the cylinders 27 and are supported from the base 12.

With attention now invited more specifically to FIG. 8, the braces 54, 58 and 62 communicate the interiors of the lower ends of the cylinder portions 32, 30 and 28, respectively, and tubes 64 extend between opposite ends of the brace 54 and opposite end portions of the brace 42, the tubes 64 communicating the lower ends of the cylinder portions 32 with the upper ends of the piston rod portions 31. Further, communicating tubes 66 extend between opposite end portions of the brace 58 and corresponding opposite end portions of the brace 56 into which the upper ends of the piston rod portions 29 of the cylinders 27 open. Thus, the interiors of the cylinders 25, 26 and 27 are in full communication with each other. Also, it will be noted from FIG. 8 of the drawings that compression springs 68 and 70 are disposed between the opposite ends of the braces 54 and 58 and between the opposite ends of the braces 58 and 62 to cushion lowering of the braces 54 relative to the braces 58 and lowering of the braces 58 relative to the braces 62.

Figure 3:
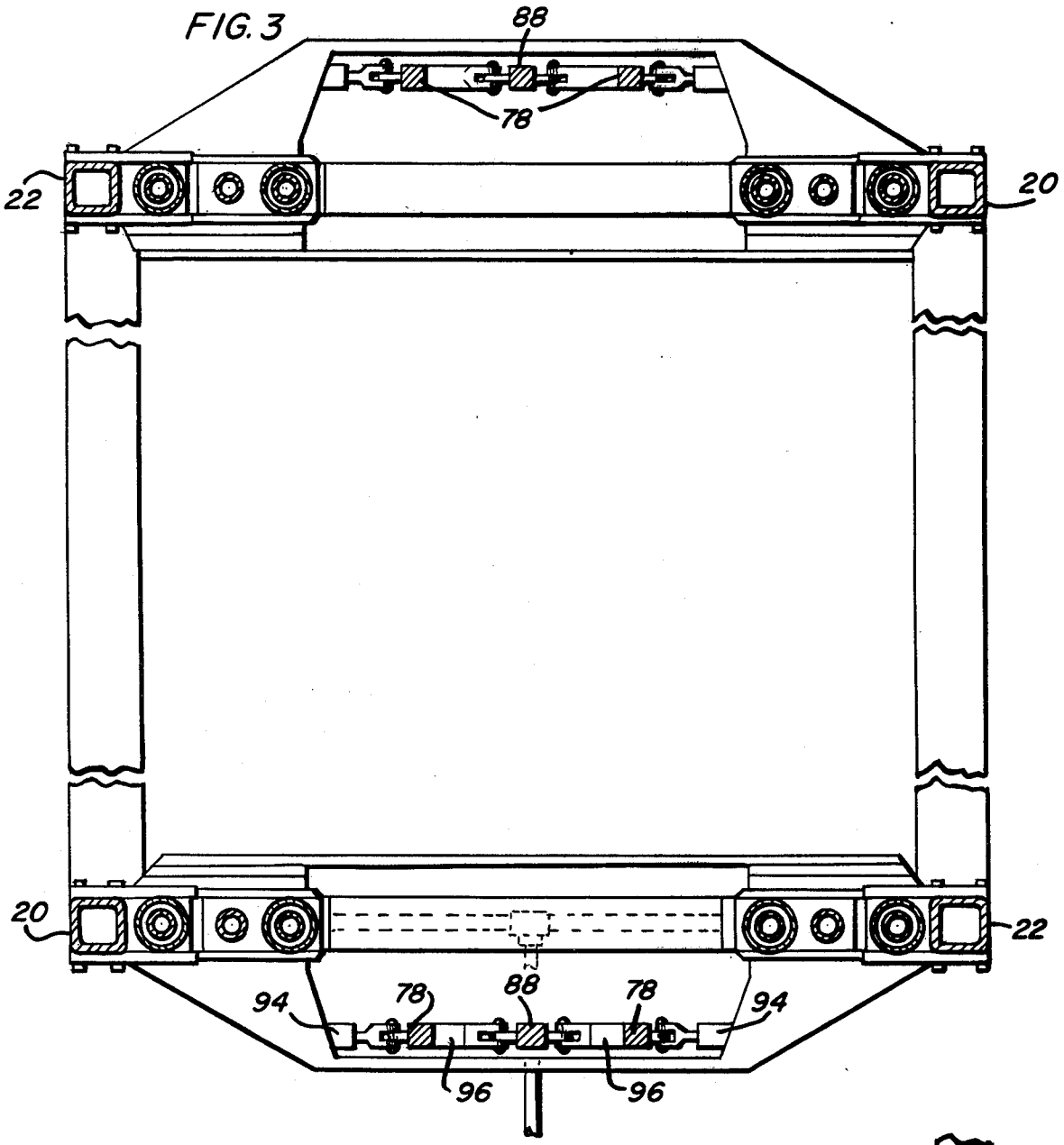
FIG. 3 is an enlarged fragmentary horizontal sectional view taken substantially upon the plane indicated by the second line 3—3 of FIG. 1.
Figure 4:
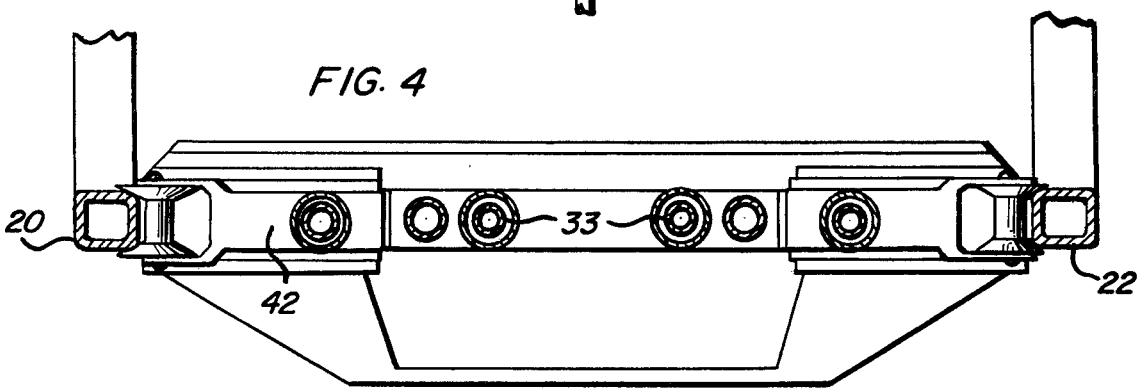
FIG. 4 is an enlarged fragmentary horizontal sectional view taken substantially upon the plane indicated by the section line 4—4 of FIG. 1.

Each side frame 14 and 16 includes a horizontal midheighth brace 74 extending between the guides 20 and 22 thereof and each brace 74 and the corresponding side of the base 12 includes pairs of upper and lower spring biased guide pins 76 and the upper and lower pins of each side frame 14 and 16 support the upper and lower ends of vertical actuating bars 78 whose lower ends include support wheels 80. The bars 78 each include three vertically spaced cam ramps 82, 84 and 86 and a lengthwise reciprocal vertical actuating rod 88 is supported from each side frame 14 and 16 and includes a piston 90 on its lower end reciprocal in a cylinder 92 with which the inlet end of a vent line 92' is communicated. Each actuating rod 88 includes three vertically spaced pairs of rollers 93 engageable with the cam ramps 82, 84 and 86. When the rod 78 is disposed in its upper position illustrated in FIG. 1, the bars 78 are biased apart. When the rod 88 is lowered, the rollers 93 thereof move below the cam ramps 82, 84 and 86 and allow the bars 88 to move toward each other. The braces 54, 58 and 62 each support safety valves 94 therefrom connected to the rod 88 via suitable linkage 96, see FIG. 3 and the safety valves 94 are operative upon lowering of the actuating rod 88, to prevent the flow of hydraulic fluid from the cylinder portions of the cylinders 25, 26 and 27 and thus prevent unwanted lowering of the lifting heads 36.

Figure 9:
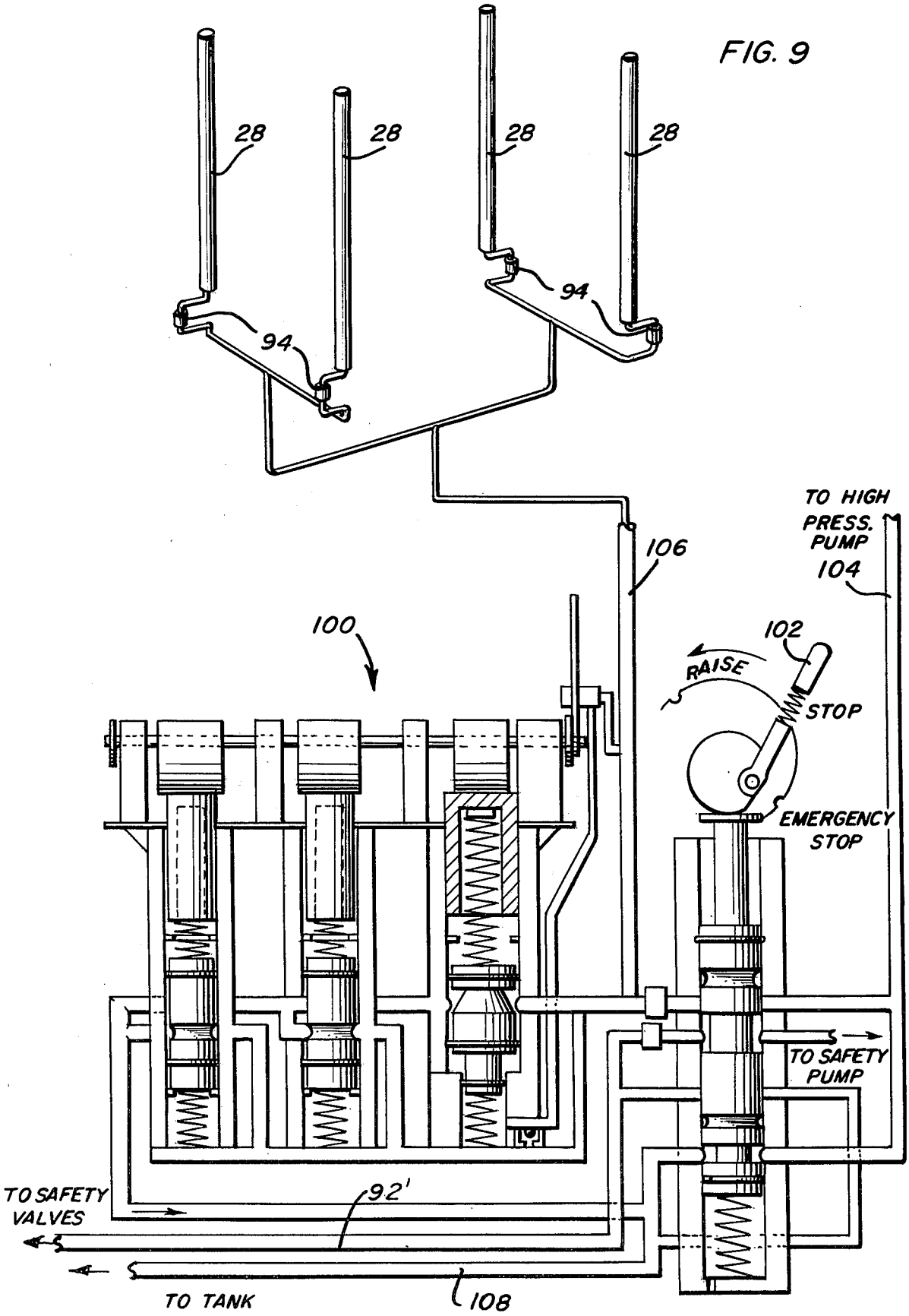
FIG. 9 is a schematic view illustrating the hydraulic fluid supply system for the hoist and the manner in which the hydraulic supply system is operatively communicated with the lower cylinder portions of the lowermost cylinders and further illustrating the manner in which the safety valves for the lowermost cylinders are operatively associated therewith.

FIG. 9 schematically illustrates a hydraulic control assembly referred to in general by the reference numeral 100 including a detent equipped actuator 102. A line 104 supplies high pressure fluid from a pump (not shown) to the hydraulic control assembly 100 and a line 106 extends to the hydraulic cylinders while line 108 extends to a hydraulic fluid storage tank and line 94 extends to cylinder 92 as hereinbefore set forth.

It is to be understood that the hydraulic control assembly 100 does not comprise a part of the instant invention. It is only necessary to understand that the actuator 102 of the assembly 100 may be utilized to effectively selectively extend and retract the hydraulic cylinders 26, 28 and 30 and to vent the cylinder 92 whereby the rod 88 will become lowered and the safety valves 94 will automatically close off the lower ends of the cylinder portions of the cylinders 25, 26 and 27. In any event, when the actuator 102 is moving to the "emergency stop" position, see FIG. 9, the line 94 is vented through the assembly 100 and the rod 88 drops by gravity to allow the bars 78 to move inwardly toward each other and effect closing of the various safety valves 94 to lock the cylinders 25, 26 and 27 against extension or retraction.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. A fluid pressure hoist including an upright frame having a pair of opposite sides, a pair of upstanding guides on each opposite side, at least two pairs of first upper and second lower vertically extendible hydraulic cylinders on each opposite side of said frame, each cylinder including relatively extendible tubular upper and lower telescopingly engaged portions, each opposite side including a first upper brace extending between the upper ends of the upper portions of the upper cylinders and guidingly engaged with said guides, a second brace extending between the upper ends of the lower portions of said upper cylinders as well as the upper ends of the upper portions of the lower cylinders and guidingly engaged with said guides, a third brace extending between the lower ends of the lower portions of the upper cylinders, a fourth brace extending between the upper ends of the lower portions of the lower cylinders, the upper ends of the second lower cylinder upper portions being in fluid communication with the lower ends of the upper cylinder lower portions, a third lowest pair of vertically extendible hydraulic cylinders on each opposite side of said frame, said fourth brace also extending between the upper ends of the upper portions of the third cylinders and guidingly engaged with the corresponding guides, a fifth brace extending between the lower ends of the lowest portions of the second cylinders, the upper ends of the third cylinder upper portions being in fluid communication with the lower ends of the second cylinder lower portions and means operative to selectively communicate said lower portions of said third cylinders with a source of fluid under pressure.

2. The combination of claim 1 including safety valves operatively associated with the lower portions of each of the first, second and third cylinders and operative to selectively prevent hydraulic fluid venting from said first, second and third cylinder lower portions.

3. The combination of claim 2 including actuator means on each opposite side of said frame operatively connected to the corresponding safety valves for simultaneous closing thereof in response to operation of said actuator means.

4. The combination of claim 3 wherein said means operative to selectively communicate said lower portions of said third cylinders with a source of fluid under pressure also includes means for simultaneous operation of said actuator means.

5. A fluid pressure hoist including an upright frame having a pair of opposite sides, each of said opposite sides including first upper, second intermediate and third lower hydraulic cylinders, each of said hydraulic cylinders including upper tubular piston rod and lower tubular cylinder portions, a lifting head connected between the upper ends of the piston rod portions of the upper cylinders, means providing fluid communication with the interiors of the lower ends of the lower cylinder portions of the upper cylinders with the interiors of the upper ends of the piston rod portions of the intermediate cylinders and means providing fluid communication with the lower ends of the interiors of the cylinder portions of the intermediate cylinders with the interiors of the upper end portions of the piston rod portions of the lower cylinders, means providing fluid communication with the interiors of the upper ends of the upper piston rod portions of the upper cylinders, first brace means interconnecting the upper ends of the upper cylinders and the upper ends of the piston rod portions of the intermediate cylinders and guidingly engaged with the corresponding side of said frame, second brace means interconnecting the upper ends of the intermediate cylinders and the upper ends of the piston rod portions of the lower cylinders and guidingly engaged with the corresponding side of said frame, and means operative to selectively communicate the lower cylinder portions of the lower cylinders with a source of fluid under pressure.

6. The combination of claim 5 wherein each of said opposite sides of said frame includes a pair of opposite side upright guides, said first brace means extending between and being guidingly engaged with the corresponding guides.

7. The combination of claim 6 wherein said second brace means extends between and is guidingly engaged with the corresponding guides.

* * * * *